US008007077B2

(12) United States Patent
Kudo et al.

(10) Patent No.: US 8,007,077 B2
(45) Date of Patent: Aug. 30, 2011

(54) INKJET HEAD

(75) Inventors: Satoshi Kudo, Machida (JP); Genji Inada, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 467 days.

(21) Appl. No.: 12/333,282

(22) Filed: Dec. 11, 2008

(65) Prior Publication Data

US 2009/0153633 A1 Jun. 18, 2009

(30) Foreign Application Priority Data

Dec. 14, 2007 (JP) ..... 2007-323674

(51) Int. Cl.
*B41J 2/05* (2006.01)

(52) U.S. Cl. ..... 347/63; 347/65

(58) Field of Classification Search ..... 347/20, 347/40, 54, 56, 61, 6, 653
See application file for complete search history.

(56) References Cited

U.S. PATENT DOCUMENTS 6,863,381 B2 3/2005 Parish
7,845,766 B2 * 12/2010 Kimura et al. ..... 347/65

* cited by examiner

*Primary Examiner* — Huan Tran
(74) *Attorney, Agent, or Firm* — Canon USA Inc IP Division

(57) ABSTRACT

An inkjet head includes a recording element substrate, on which sets of energy generating elements generating energy to discharge ink and a supply port supplying ink to discharge ports are arranged, and an orifice plate including the discharge ports. The sets include a set having a first supply port disposed at a first edge of the substrate and a set having a second supply port disposed at a second edge of the substrate opposite the first edge. The distance between the second edge and the second supply port is shorter than the distance between the first edge and the first supply port. A contact area between the substrate and second channel walls that form second ink channels communicating with the second supply port is larger than the contact area between the substrate and first channel walls that form first ink channels communicating with the first supply port.

6 Claims, 9 Drawing Sheets

INKJET HEAD

BACKGROUND OF THE INVENTION

1. Field of the Invention

The present invention relates to an inkjet head that performs recording by discharging ink to a recording surface of a recording medium. In particular, the present invention relates to an inkjet head including supply ports that extend through a recording element substrate and an orifice plate stacked on the recording element substrate.

2. Description of the Related Art

An inkjet recording apparatus, which uses a non-impact recording method, has advantages of making little noise during recording and performing high-speed and high-resolution recording on various recording media. Examples of the inkjet recording apparatus include the apparatus having such characteristics described in U.S. Pat. No. 6,863,381. The document discloses a configuration in which nozzle arrays for discharging ink are each disposed on one side of a corresponding supply port (ink via) on a recording element substrate (heater chip), and the distances from longitudinal edges of outermost supply ports to edges of the recording element substrate are different.

In recent years, recording element substrates have been becoming smaller as printers and the inkjet heads have been miniaturized for cost reduction. U.S. Pat. No. 6,863,381 proposes a configuration in which nozzle channels, which had previously been formed on both sides of each of the supply ports, are disposed on one side of each of the supply ports with higher density. This serves to save space at the unused sides and downsize the recording element substrate.

When a recording element substrate having an orifice plate stacked thereon is bonded to a resin inkjet head member with a thermosetting adhesive, a compressive stress is applied to the recording element substrate at normal temperature, because a resin generally has a larger linear expansion coefficient than a metal that composes the recording element substrate.

FIG. 8 shows a schematic view of an inkjet head disclosed in U.S. Pat. No. 6,863,381. As shown in the figure, if the compressively-stressed part of the recording element substrate has a low rigidity, the orifice plate is deformed together with the recording element substrate 1. Thus, ground areas (hereinafter also referred to as channel walls), which connect the orifice plate and the recording element substrate so as to form ink channels, may become unstuck. In an area where ink channels are formed between an edge of the recording element substrate 1 and a supply port, a driving circuit and wiring for energy generating elements are disposed. Because downsizing is difficult for such a part, this part serves to ensure sufficient width and rigidity near the edge of the recording element substrate 1.

FIG. 9 shows a configuration of an inkjet head disclosed in U.S. Pat. No. 6,863,381. In FIG. 9, three supply ports 30, 40, and 50 are provided. Energy generating elements H10, H20, and H30 are arranged at the respective supply ports 30, 40, and 50. In the configuration disclosed in U.S. Pat. No. 6,863,381, as shown in FIG. 9, the distances from edges of a recording element substrate 1 to the supply ports nearest to the edges (supply ports 50 and 30) are different for different edges. As shown in FIG. 8, ink channels are not formed in an area between a supply port and an edge of the recording element substrate at one edge of the substrate (the right edge of the recording element substrate in FIGS. 8 and 9). When this area is too small, rigidity of the area may be low and channel walls may become unstuck.

SUMMARY OF THE INVENTION

The present invention provides an inkjet head that discharges ink stably by adjusting the adherence between the orifice plate and the recording element substrate to prevent the orifice plate and the recording element substrate from becoming unstuck.

An inkjet head according to an embodiment of the present invention includes a recording element substrate on which a plurality of sets of energy generating elements and a supply port are arranged in an arrangement direction, the energy generating elements being configured to generate energy to discharge ink from discharge ports, and the supply port facilitating supplying of ink to the discharge ports; and an orifice plate including the discharge ports. The plurality of sets include a set having a first supply port disposed at a first edge of the recording element substrate and a set having a second supply port disposed at a second edge of the recording element substrate, the second edge being opposite the first edge with respect to the arrangement direction. The distance between the second edge and the second supply port is shorter than the distance between the first edge and the first supply port with respect to the arrangement direction. A contact area between the recording element substrate and second channel walls that form a plurality of second ink channels communicating with the second supply port is larger than a contact area between the recording element substrate and first channel walls that form a plurality of first ink channels communicating with the first supply port.

The present invention prevents the channel walls from becoming unstuck to achieve stable discharging. This realizes a smaller and longer recording element and a denser and longer inkjet head, thereby satisfying a demand for a printer with a smaller size, a higher resolution, and a faster recording speed.

Further features of the present invention will become apparent from the following description of exemplary embodiments with reference to the attached drawings.

DESCRIPTION OF THE EMBODIMENTS

Figure 7:
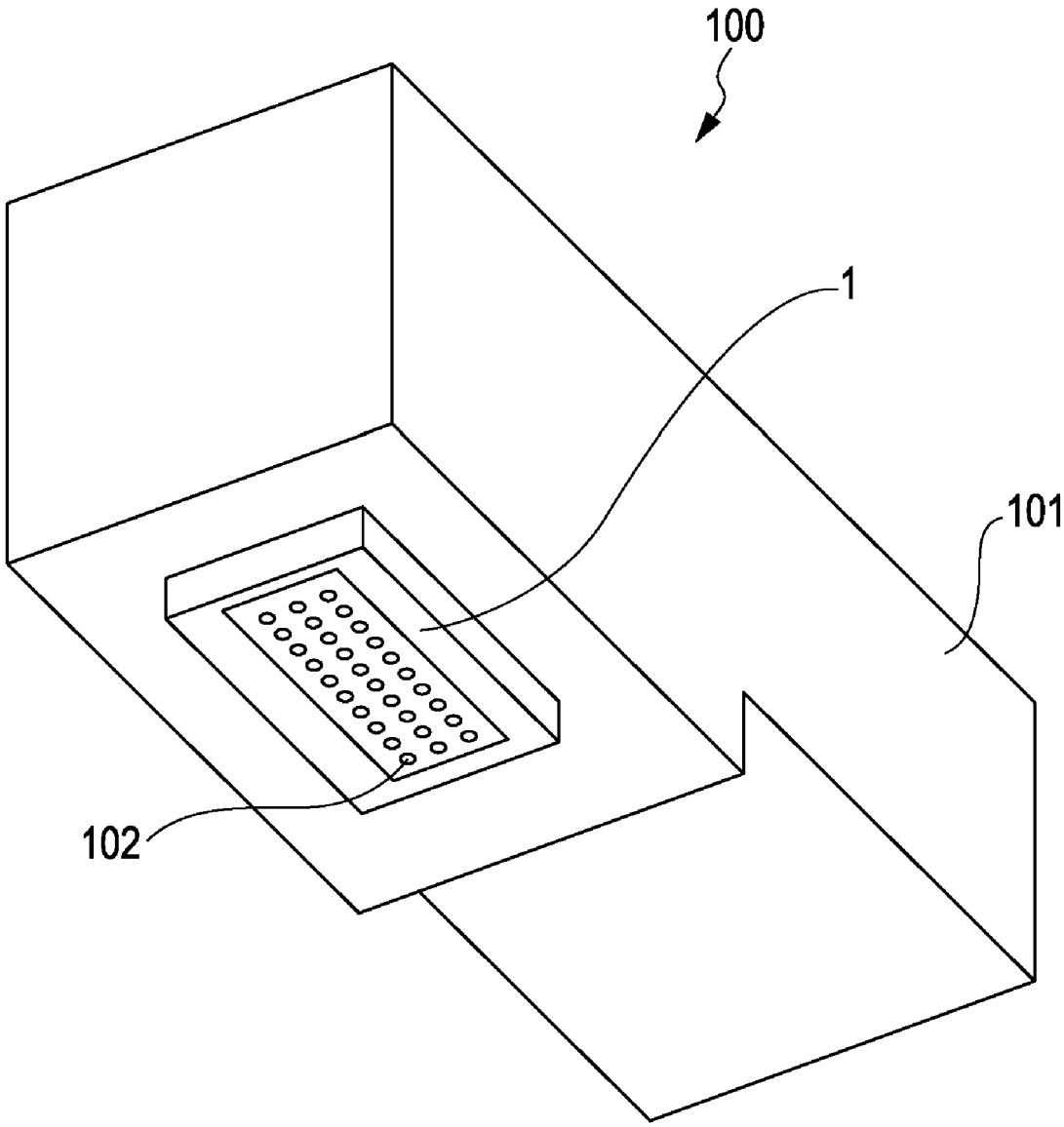
FIG. 7 shows a perspective view of an inkjet head according to an embodiment of the present invention.
Figure 8:
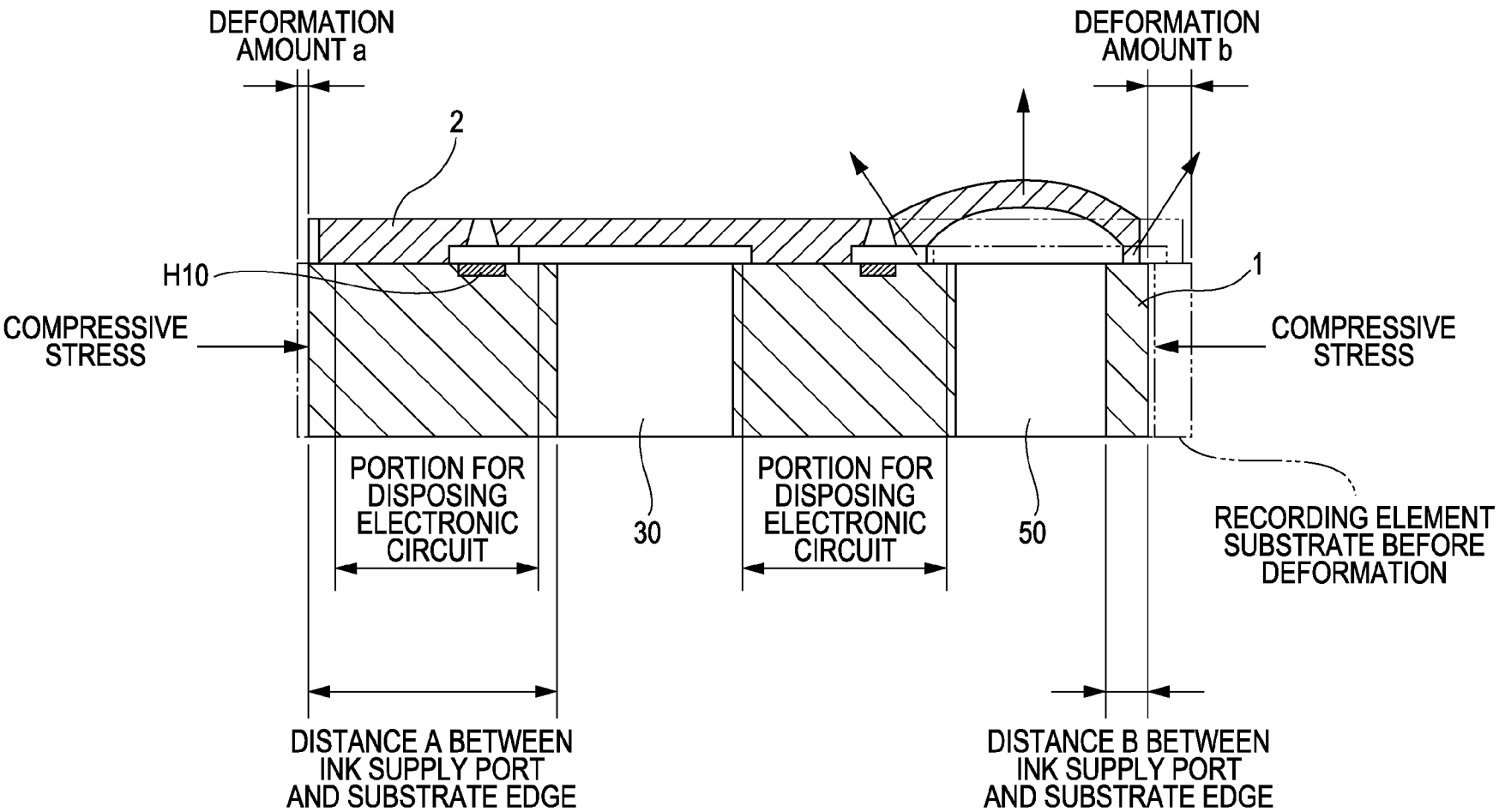
FIG. 8 PRIOR ART
FIG. 8 is a schematic view for describing the existing art.
Figure 9:
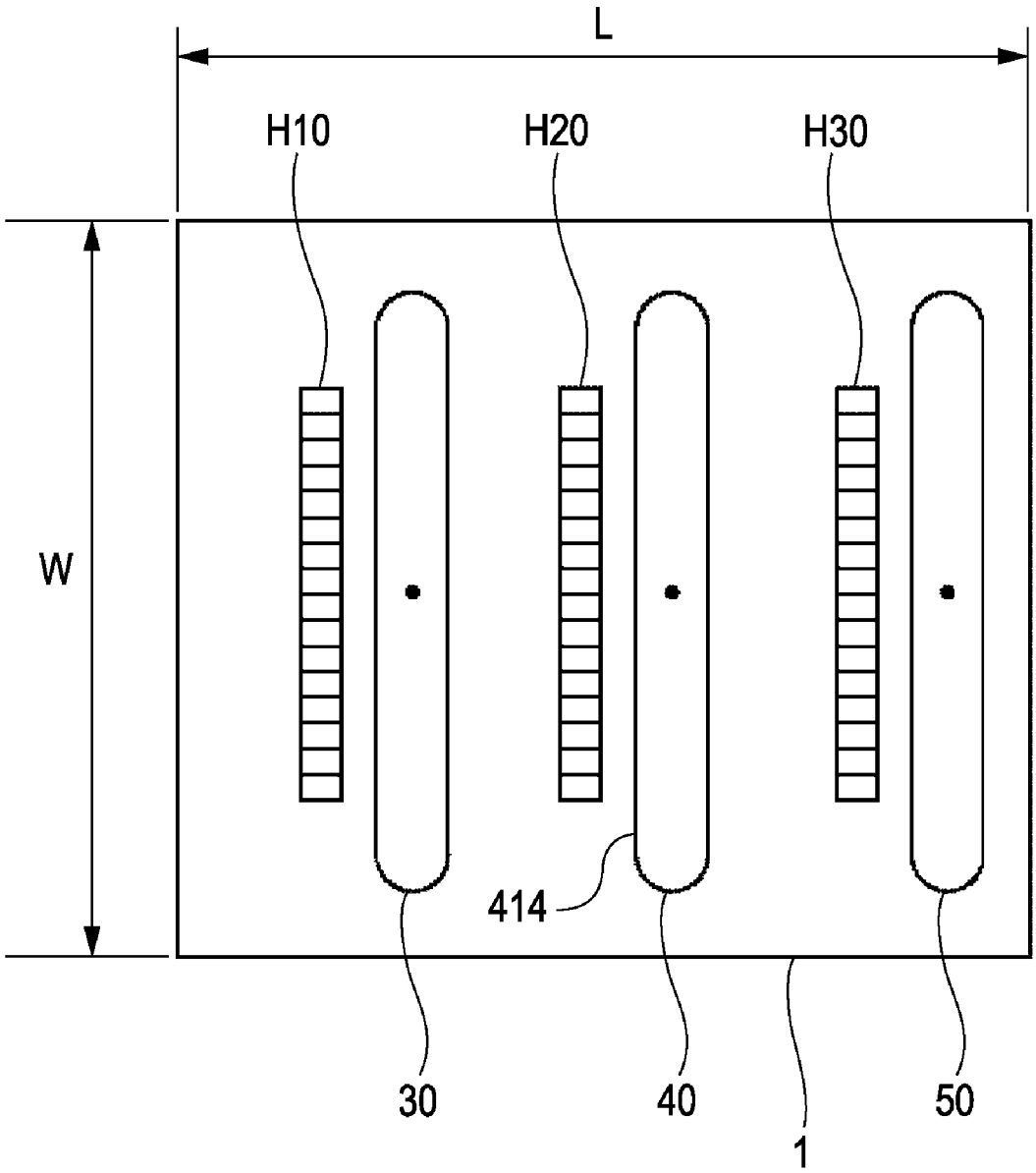
FIG. 9 PRIOR ART
FIG. 9 is a schematic view for describing the existing art.

An embodiment of the present invention is described with reference to the drawings. FIG. 7 shows an inkjet head 100 of a configuration used in the embodiment. The inkjet head 100 includes a housing 101 made of a material suitable for holding ink. The housing 101 has ink chambers (not shown) prepared separately for different colors of ink. Cyan, magenta, and yellow inks are used in the embodiment. The inkjet head 100 includes discharge ports 102 and an orifice plate 2 including ink channels leading to the discharge ports 102. In the embodiment, the orifice plate 2 is made of resin and stacked on a recording element substrate 1 by a process such as photolithography.

The recording element substrate 1 is bonded to the housing 101 with an adhesive. Supply ports for different colors of ink are disposed so as to extend through the recording element substrate 1. The supply ports are connected to the ink chambers for the corresponding colors of ink in the housing 101 by way of ink supply paths. The supply ports are formed by processing the recording element substrate 1 by such methods as dry etching, wet etching, or sandblasting. Electrical wiring extending from the recording element substrate 1 to electrical contacts providing connection with the main body of the inkjet recording apparatus is formed as a tape automated bond (TAB) circuit (not shown) or the like.

The embodiment has three supply ports corresponding to the three colors of ink. However, the present invention is not limited to the embodiment and is applicable to the case where more than three colors are used and more than three supply ports are provided.

Figure 1:
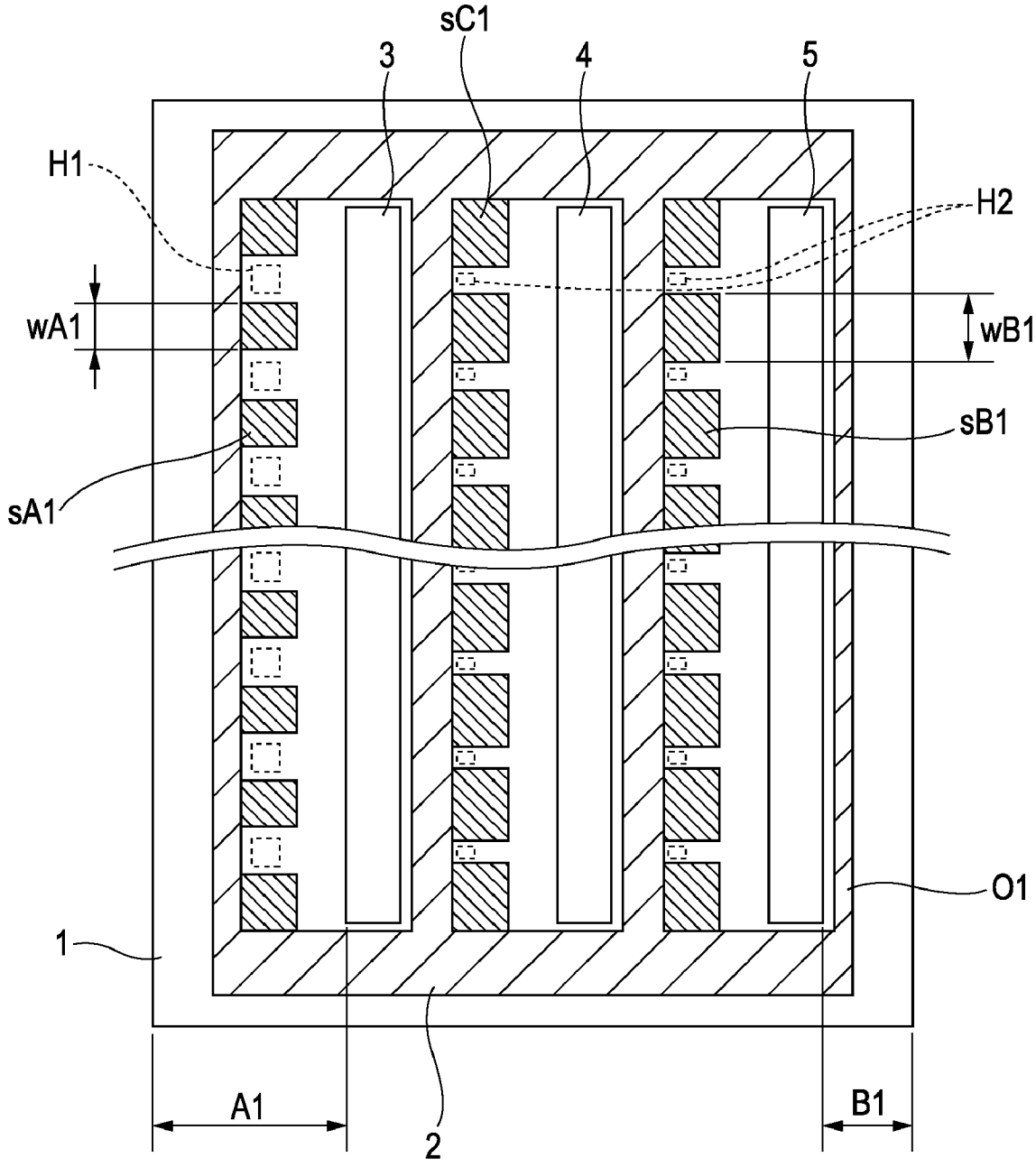
FIG. 1 shows a schematic view of a recording head according to a first embodiment of the present invention.

FIG. 1 shows a configuration according to a first embodiment of the present invention. FIG. 1 shows a recording element substrate 1 on which an orifice plate 2 is stacked. In the embodiment, three supply ports 3, 4, and 5, corresponding to the three colors of ink, are formed on the recording element substrate 1 so as to extend through the substrate from the back to the front.

The recording element substrate 1 contacts the orifice plate 2 at ground areas (contact areas) sA1, sB1, sC1, and O1, which are shaded in the figure. At the ground areas sA1, sB1, and sC1, the recording element substrate 1 contacts parts of the orifice plate 2 serving as channel walls of ink channels. At the ground area O1, the recording element substrate 1 contacts parts of the orifice plate 2 excluding the parts serving as the channel walls. Energy generating elements H1, H2 discharge ink.

As shown in the figure, sets of a supply port and energy generating elements are arranged in the left-right direction of the recording element substrate 1. A supply port 3 (first supply port) is disposed close to a first edge of the recording element substrate 1, and a supply port 5 (second supply port) is disposed close to a second edge of the recording element substrate 1 at the side opposite to the first edge. First ink channels are disposed so as to communicate with the supply port 3, and second ink channels are provided so as to communicate with the supply port 5.

The ink channels are disposed on one side of each of the supply ports 3, 4 and 5. In the embodiment, the ink channels are disposed on the same side for all three colors. As shown in the figure, the distance (interval) A1 between the outer edge of the supply port 3 and the first edge of the recording element substrate 1 is longer than the distance (interval) B1 between the outer edge of the supply port 5 and the second edge of the recording element substrate 1, due to constraints imposed by driving circuits and wiring for the energy generating elements H1 and H2.

As shown in FIG. 1, in the first embodiment, channel wall widths in the direction of columns of the energy generating elements (discharge ports 102 in FIG. 7) are configured such that the width wB1 is greater than the width wA1. The ink channels are disposed at the same pitch in the same direction for each of the supply ports 3, 4, and 5. The term "first channel walls" refers to channel walls of first ink channels that communicate with the supply port 3 serving as a first supply port. The term "second channel walls" refers to channel walls of second ink channels that communicate with the supply port 5 serving as a second supply port. A relation sA1<sB1 holds, where sA1 denotes the contact area between the first channel walls and the recording element substrate 1 and sB1 denotes the contact area between the second channel walls and the recording element substrate 1.

A seal is generally provided along the periphery of the recording element substrate 1. The seal generates a contraction stress that may cause the orifice plate 2 and the recording element substrate 1 to become unstuck. When A1>B1 as in the first embodiment, the contraction stress of the seal affects the B1 side more strongly than the A1 side. Therefore, the discharge ports 102 are more likely to be deformed and the channel walls and the recording element substrate 1 are more likely to become unstuck on the B1 side. However, by making sA1<sB1 as in the first embodiment, the size of the ground area on the B1 side, which is more strongly affected by the contraction stress, can be made large enough to balance the A1 side. As a result, the left side and the right side of recording element substrate 1 can be balanced in the configuration of the first embodiment in which ink channels are formed on one side of each of the supply ports. In the embodiment, the ink channels are disposed at a pitch corresponding to a density of 600 dots per inch (dpi). However, the present invention is not limited to this and is applicable to a lower density such as 300 dpi or a higher density such as 1200 dpi.

Figure 2:
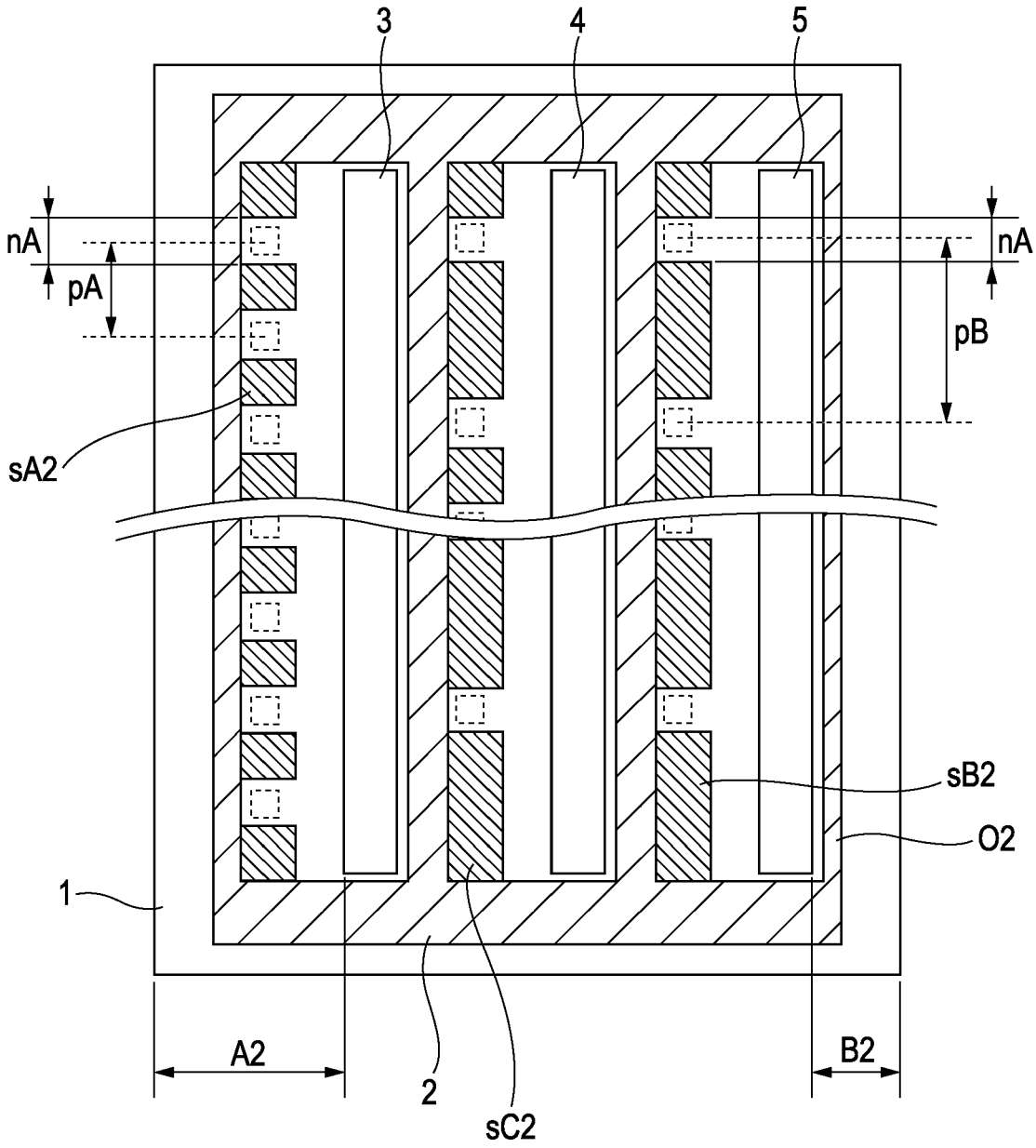
FIG. 2 shows a schematic view of a recording head according to a second embodiment of the present invention.

FIG. 2 shows a configuration according to a second embodiment of the present invention. In this embodiment, three supply ports 3, 4, and 5 are formed so as to correspond to the three colors of ink as in the first embodiment. A recording element substrate 1 contacts an orifice plate 2 at ground areas A2, sB2, sC2, and O2, which are shaded in the figure. In the second embodiment, distance A2>distance B2 as in the first embodiment.

The second embodiment in FIG. 2 differs from the first embodiment in that a pitch pA at which ink channels at the supply port 3 are disposed is shorter than a pitch pB at which ink channels at the supply port 5 are disposed. That is, channel wall widths in the direction perpendicular to the direction in which the supply ports are arranged are configured such that a width of channel walls for the supply port 5 is greater than a width of channel walls for the supply port 3.

The ink channels that communicate with the supply ports 3, 4, and 5 for the three colors have the same width nA. In the second embodiment, the pitch pA at which the ink channels are disposed corresponds to a density of 1200 dpi, and the pitch pB corresponds to a density of 600 dpi. Thus, in the second embodiment, a relation sA2<sB2 holds for the ground areas between the recording element substrate 1 and the channel walls of the ink channels.

Therefore, the size of ground areas at the B2 side in the second embodiment is larger than the size of the ground areas at the B2 side in the first embodiment. This configuration is suitable for coping with the above-described contraction stress and prevents the channel wall from becoming unstuck.

Figure 3:
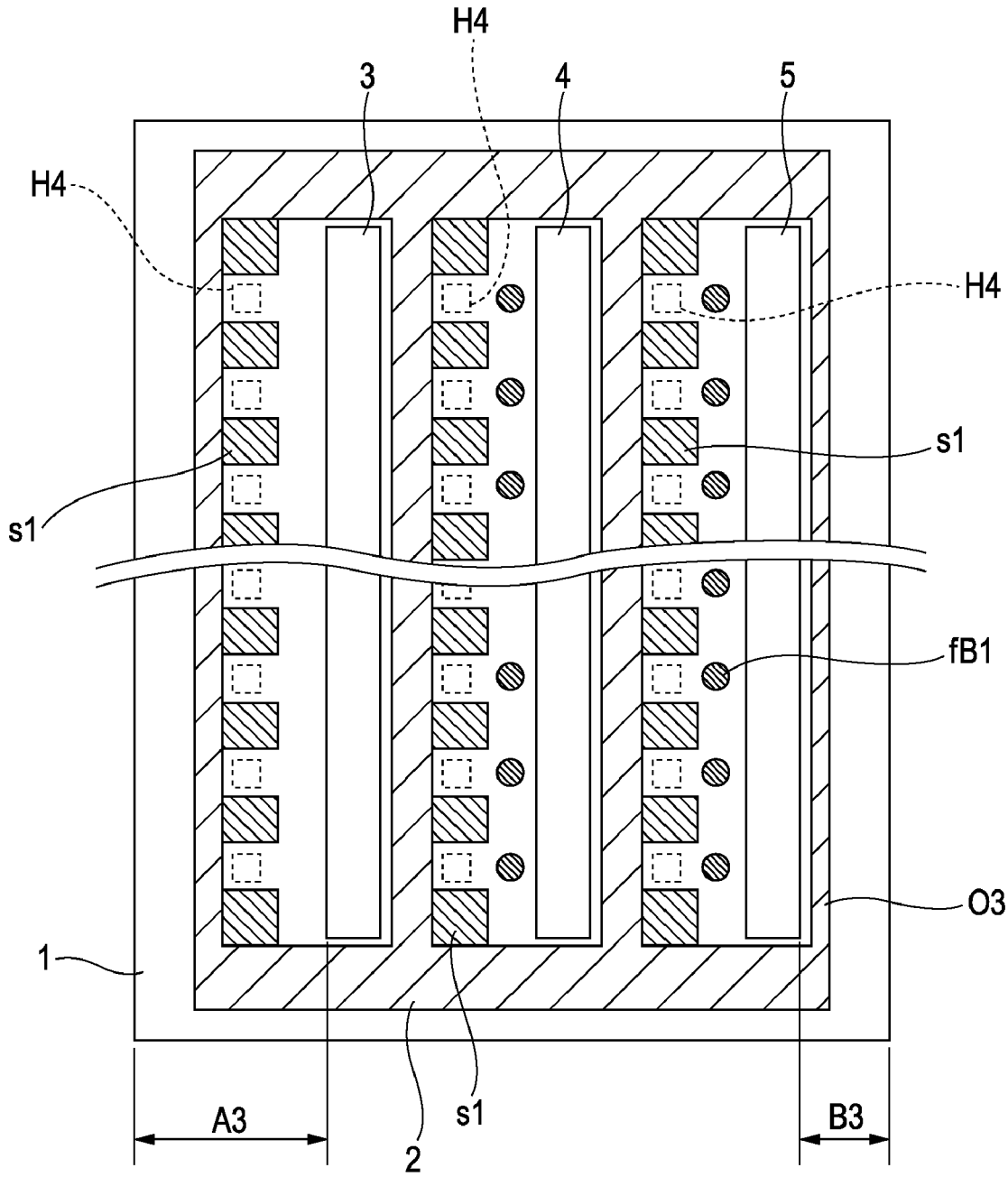
FIG. 3 shows a schematic view of a recording head according to a third embodiment of the present invention.

FIG. 3 shows a configuration according to a third embodiment of the present invention. As in the above-described embodiments, the figure shows a recording head having a recording element substrate 1 on which an orifice plate 2 is stacked. In the third embodiment, a recording element substrate 1 contacts an orifice plate 2 at ground areas s1 and O3, which are shaded in FIG. 3. At the ground area s1, the recording element substrate 1 contacts parts of the orifice plate 2 serving as channel walls of ink channels. At the ground area O3, the recording element substrate 1 contacts parts of the orifice plate 2 excluding the parts serving as the channel walls.

Energy generating elements H4 generate energy to discharge ink. In the embodiment, the ink channels for supply port 3, 4, and 5 are provided with similar ground areas s1. The ink channels are disposed on the same side of the supply port for each of the three colors. As in the above-described embodiments, a distance A3 between an edge of the supply port 3 and an outer edge of the recording element substrate 1 is longer than a distance B3 between an outer edge of the supply port 5 and the opposite edge of the recording element substrate 1; that is, a relation A3>B3 holds.

The third embodiment differs from the above-described embodiments in that the third embodiment has filters fB1 between the supply port 5 and channel walls at the supply port 5, as shown in FIG. 3. The filters fB1 connect the recording element substrate 1 to the orifice plate 2. By disposing the filters fB1 on the B3 side, the B3 side, which is strongly affected by a contraction stress, can be balanced with the A3 side that is less affected by the contraction stress. This prevents the discharge ports from being deformed and the recording element substrate 1 and the orifice plate 2 from becoming unstuck.

Figure 4:
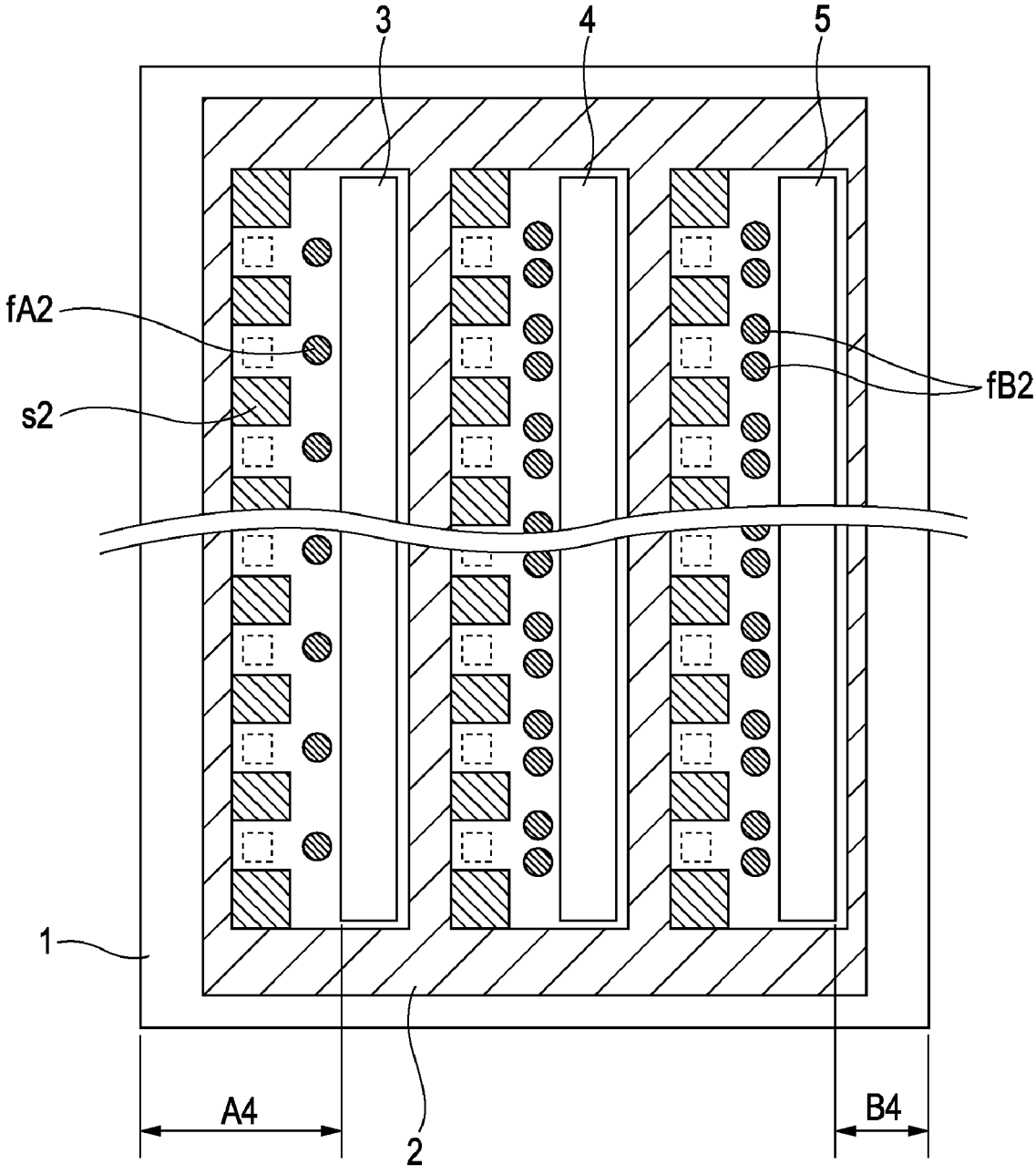
FIG. 4 shows a schematic view of a recording head according to a fourth embodiment of the present invention.

FIG. 4 shows a configuration according to a fourth embodiment of the present invention. The fourth embodiment differs from the third embodiment in that the fourth embodiment has two sets of filters fA2 and fB2. The filters fA2, which contact a recording element substrate 1, are disposed between the supply port 3 and channel walls at the supply port 3. The filters fB2, which contact the recording element substrate 1, are disposed between the supply port 5 and channel walls at the supply port 5. In the embodiment, the filters fA2 and fB2 have the same diameter and the number of filters fB2 is twice the number of filters fA2. The pitch at which ink channels are disposed is the same for the ink channels disposed at the supply ports 3, 4, and 5.

In an inkjet head of the embodiment configured such that A4>B4, the B4 side is more strongly affected by the contraction stress than the A4 side. The B4 side is configured to have a larger number of filters than the A4 side so that the sum of the contact areas between the filters and the recording element substrate 1 is larger for the B4 side than the A4 side. This serves to balance the contraction stress on the A4 side with the contraction stress on the B4 side, and make the ink channels and the recording element substrate 1 less likely to become unstuck. Moreover, by disposing the filters upstream of the ink channels as in the embodiment, minute foreign substances can be trapped before flowing into the ink channels, and ink channels for a discharge amount of as little as 1 picoliter to 3 picoliters can be provided to form a high-precision photographic image.

As described above, in the third and the fourth embodiments, the total contact area between the filters and the recording element substrate 1 at the side of the supply port on a low-rigidity part of the recording element substrate 1 is made large enough to prevent the channel walls from becoming unstuck when the low-rigidity part is deformed.

Figure 5:
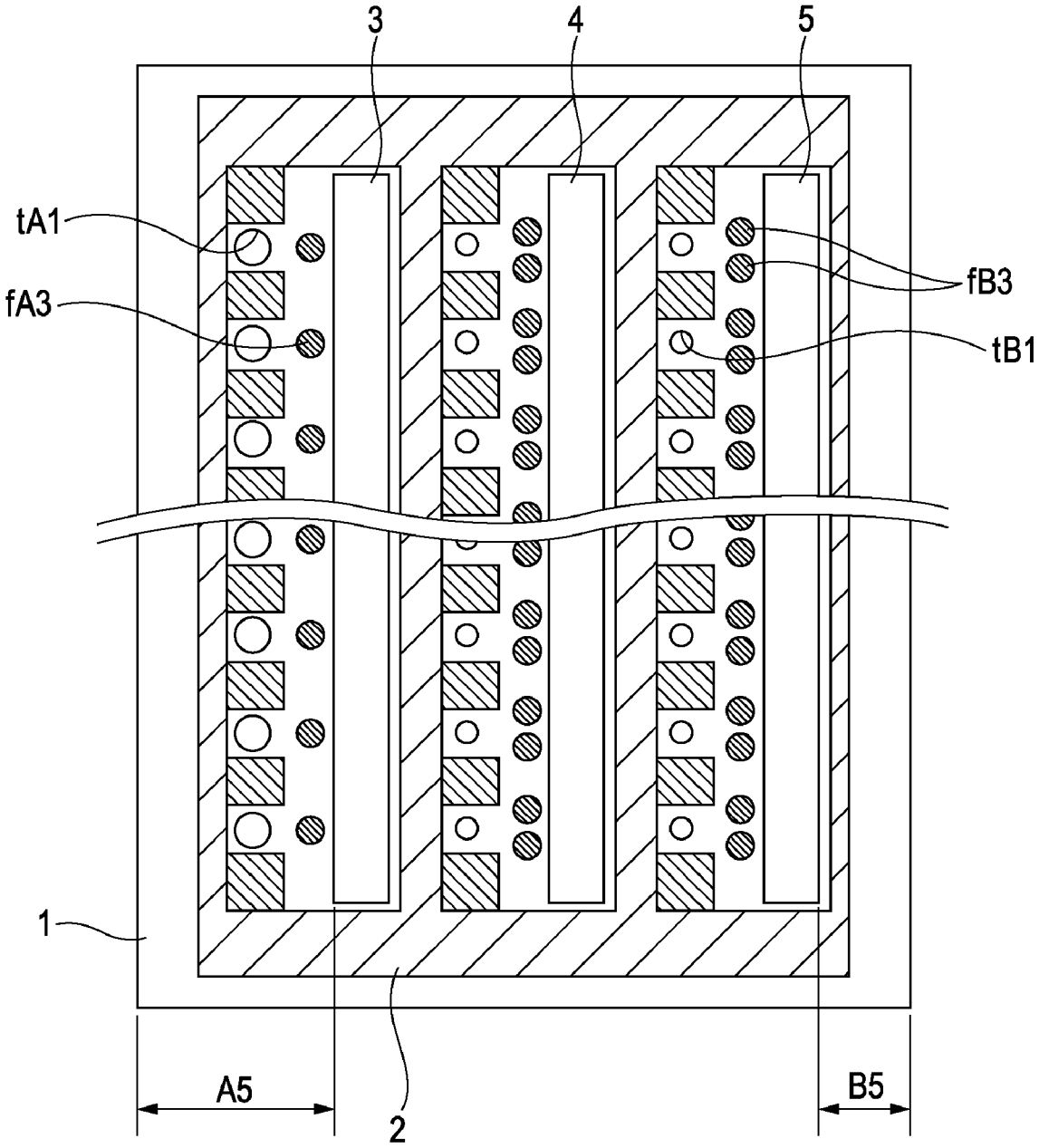
FIG. 5 shows a schematic view of a recording head according to a fifth embodiment of the present invention.

FIG. 5 shows a configuration according to a fifth embodiment of the present invention. In contrast to the fourth embodiment, the amount of ink discharged from each discharge port tA1 at the supply port 3 is 5 picoliters, and the amount of ink discharged from each discharge port tB1 at the supply port 5 is 1 picoliter. That is, an inkjet head is configured such that A5>B5 and the discharge amount at the B5 side is larger than the discharge amount at the A5 side.

In the embodiment, filters fA3 and fB3 have the same diameter, and the number of filters fB3 is twice the number of filters fA3 for the 5-picoliter channels. Thus, the filters fB3 block minute foreign substances from flowing into the channels and adjust the resistance of flow from 5-picoliter channels to 2-picoliter channels, and the filters fA3 create smaller flow resistance, thereby realizing excellent refillability. A configuration without the filters fA3 is also effective depending on the desired refillability.

Figure 6:
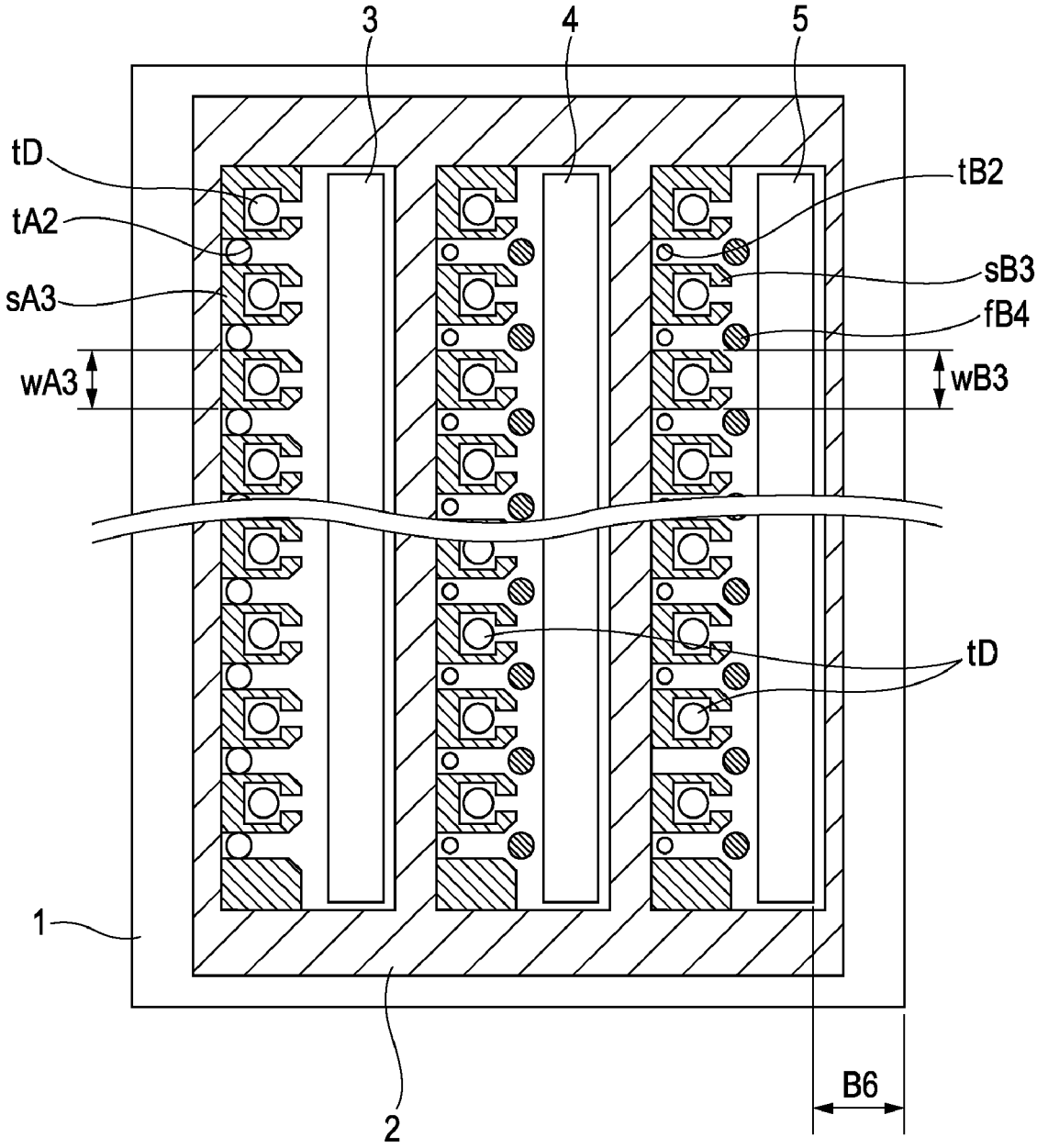
FIG. 6 shows a schematic view of a recording head according to a sixth embodiment of the present invention.

FIG. 6 shows a configuration according to a sixth embodiment of the present invention. In this embodiment, the amount of ink discharged from each discharge port tA2 at the supply port 3 is 5 picoliters and the amount of ink discharged from each discharge port tB2 at the supply port 5 is about 1 picoliter. Ink channels for discharge ports tD with a discharge amount of 10 picoliters are disposed in a staggered manner between the ink channels. To achieve excellent refillability, discharge ports with a larger discharge amount are disposed closer to the supply port. In this embodiment, the ink channels are disposed at the same pitch corresponding to 1200 dpi at each of the supply ports 3, 4, and 5.

In this embodiment, the ground area sA3 is smaller than the ground area sB3 (sA3<sB3), because a width wB3 of channel walls forming ink channels for discharge amounts of 1 and 10 picoliters is greater than a width wA3 of channel walls forming ink channels for discharge amounts of 5 and 10 picoliters (wA3<wB3).

As in the above-described embodiments, the channel walls are prevented from becoming unstuck by disposing the ink channels having a large ground area (the ink channels for discharge amounts of 1 and 10 picoliters) at the B6 side for which the distance from the supply port to an edge of a recording element substrate 1 is short. By disposing filters fB4 at the ink channels with a discharge amount of 1 picoliter, adhesion strength of the channel walls at the B6 side is improved further. In contrast, filters are not disposed for the ink channels with a discharge amount of 5 picoliters to achieve stable refillability.

As in the above-described embodiments, the inkjet head in this embodiment forms a photographic image by discharging different amounts of ink. A desired photographic image property is achieved by discharging yellow ink from the 5-picoliter discharge ports tA2 and cyan ink from the 1-picoliter discharge ports tB2. Image gradation and image forming speed are improved by providing a 10-picoliter discharge amount to ink channels for all colors.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-323674 filed Dec. 14, 2007, which is hereby incorporated by reference herein in its entirety.

What is claimed is:

1. An inkjet head, comprising:

a recording element substrate on which a plurality of sets of energy generating elements and a supply port are arranged in an arrangement direction, the energy generating elements being configured to generate energy to discharge ink from discharge ports, and the supply port facilitating supplying of ink to the discharge ports; and an orifice plate including the discharge ports, wherein the plurality of sets include a set having a first supply port disposed at a first edge of the recording element substrate and a set having a second supply port disposed at a second edge of the recording element substrate, the second edge being opposite the first edge with respect to the arrangement direction, wherein the distance between the second edge and the second supply port is shorter than the distance between the first edge and the first supply port with respect to the arrangement direction, and wherein a contact area between the recording element substrate and second channel walls that form a plurality of second ink channels communicating with the second supply port is larger than a contact area between the recording element substrate and first channel walls that form a plurality of first ink channels communicating with the first supply port.

2. The inkjet head according to claim 1, wherein a width of the second channel walls is larger than a width of the first channel walls with respect to the direction perpendicular to the arrangement direction.

3. The inkjet head according to claim 1, further comprising:

a plurality of filters disposed between each supply port and the corresponding ink channels, the filters connecting the recording element substrate to the orifice plate, wherein a sum of the contact areas between the recording element substrate and the filters disposed between the second supply port and the second ink channels is larger than a sum of the contact areas between the recording element substrate and the filters disposed between the first supply port and the first ink channels.

4. The inkjet head according to claim 1, wherein an amount of ink discharged from the discharge ports communicating with the second supply port is smaller than an amount of ink discharged from the discharge ports communicating with the first supply port.

5. The inkjet head according to claim 1, wherein a color of ink discharged from the discharge ports communicating with the first supply port is yellow.

6. The inkjet head according to claim 1, wherein the ink channels communicating with the corresponding supply ports are disposed on one side of the supply ports with respect to the arrangement direction.

* * * * *